US010465555B2

(12) United States Patent
Ogawara et al.

(10) Patent No.: US 10,465,555 B2
(45) Date of Patent: Nov. 5, 2019

(54) AIRFOIL FOR AXIAL FLOW MACHINE

(71) Applicant: IHI Corporation, Koto-ku (JP)

(72) Inventors: Kazuto Ogawara, Tokyo (JP); Takahiro Shimada, Tokyo (JP)

(73) Assignee: IHI Corporation, Koto-ku (JP)

( * ) Notice: Subject to any disclaimer, the term of this patent is extended or adjusted under 35 U.S.C. 154(b) by 380 days.

(21) Appl. No.: 15/395,044

(22) Filed: Dec. 30, 2016

(65) Prior Publication Data

US 2017/0107849 A1 Apr. 20, 2017

Related U.S. Application Data

(63) Continuation of application No. PCT/JP2015/071709, filed on Jul. 30, 2015.

(30) Foreign Application Priority Data

Nov. 17, 2014 (JP) ..... 2014-232452

(51) Int. Cl.
*F04D 29/54* (2006.01)
*F01D 25/06* (2006.01)
(Continued)

(52) U.S. Cl.
CPC ..... *F01D 25/06* (2013.01); *F01D 5/10* (2013.01); *F01D 5/16* (2013.01); *F01D 5/26* (2013.01);
(Continued)

(58) Field of Classification Search
CPC ..... F01D 5/16; F01D 5/26
See application file for complete search history.

(56) References Cited

U.S. PATENT DOCUMENTS 5,411,370 A 5/1995 Varsik
5,947,688 A * 9/1999 Schilling ..... F01D 5/147 416/233
(Continued)

FOREIGN PATENT DOCUMENTS

JP 1-139001 U 9/1989
JP 6-193401 7/1994
(Continued)

OTHER PUBLICATIONS

International Search Report dated Oct. 20, 2015 in PCT/JP2015/071709, filed on Jul. 30, 2015 ( with English Translation).
(Continued)

*Primary Examiner* — Patrick Hamo
(74) *Attorney, Agent, or Firm* — Oblon, McClelland, Maier & Neustadt, L.L.P.

(57) ABSTRACT

An airfoil for an axial flow machine includes: an airfoil body extending in a radial direction; a platform (an end wall) provided at an end portion of the airfoil body in the radial direction, the end wall being formed into a plate shape as a wall of a channel in which the airfoil body is installed and which supports the airfoil body; and at least one convex portion formed so as to protrude from a back surface of the platform in a direction away from the airfoil body. The convex portion is formed integrally with a portion for generating a node of a primary vibration mode when an edge portion of the platform vibrates as a free end of the primary vibration mode.

22 Claims, 8 Drawing Sheets

(51) Int. Cl.

| | |
|---|---|
| ***F01D 5/10*** | (2006.01) |
| ***F01D 5/26*** | (2006.01) |
| ***F01D 9/02*** | (2006.01) |
| ***F01D 25/00*** | (2006.01) |
| ***F04D 29/66*** | (2006.01) |
| ***F01D 5/16*** | (2006.01) |
| ***F01D 9/04*** | (2006.01) |
| ***F04D 29/32*** | (2006.01) |

(52) U.S. Cl.

CPC ..... *F01D 9/02* (2013.01); *F01D 9/041* (2013.01); *F01D 25/00* (2013.01); *F04D 29/324* (2013.01); *F04D 29/54* (2013.01); *F04D 29/542* (2013.01); *F04D 29/66* (2013.01); *F05D 2220/323* (2013.01); *F05D 2250/711* (2013.01)

(56) References Cited

U.S. PATENT DOCUMENTS

| | | | | |
|---|---|---|---|---|
| 6,102,664 | A * | 8/2000 | Nguyen | F01D 5/26 416/248 |
| 6,364,616 | B1 * | 4/2002 | Stevenson | B64C 11/00 416/224 |
| 6,779,979 | B1 * | 8/2004 | Wadia | F01D 5/145 416/236 R |
| 7,121,801 | B2 * | 10/2006 | Surace | F01D 5/16 416/193 A |
| 8,087,881 | B1 | 1/2012 | Cardoso, III et al. | |
| 9,267,380 | B2 * | 2/2016 | Houston | F01D 5/16 |
| 9,470,095 | B2 * | 10/2016 | Propheter-Hinckley | F01D 5/16 |
| 2006/0120875 | A1 * | 6/2006 | Surace | F01D 5/16 416/248 |
| 2008/0072569 | A1 | 3/2008 | Moniz et al. | |
| 2013/0121833 | A1 | 5/2013 | Lucashu et al. | |
| 2013/0280045 | A1 | 10/2013 | Dolansky et al. | |
| 2017/0107849 | A1 * | 4/2017 | Ogawara | F01D 5/10 |

FOREIGN PATENT DOCUMENTS

| | | |
|---|---|---|
| JP | 7-4203 | 1/1995 |
| JP | 9-70860 | 3/1997 |
| JP | 2001-27103 | 1/2001 |
| JP | 2004-324646 | 11/2004 |
| JP | 2007-537385 | 12/2007 |
| JP | 2008-82337 | 4/2008 |
| JP | 2011-196179 | 10/2011 |
| JP | 2014-122584 | 7/2014 |
| WO | WO 2005/111377 A1 | 11/2005 |

OTHER PUBLICATIONS

Written Opinion dated Oct. 20, 2015 in PCT/JP2015/071709, filed on Jul. 30, 2015.

Extended European Search Report dated Jan. 22, 2018 in Patent Application No. 15860712.7, citing documents AA—AE therein, 8 pages.

* cited by examiner

AIRFOIL FOR AXIAL FLOW MACHINE

CROSS REFERENCE TO RELATED APPLICATIONS

This application is a continuation application of International Application No. PCT/JP2015/071709, filed on Jul. 30, 2015, which claims priority to Japanese Patent Application No. 2014-232452, filed on Nov. 17, 2014, the entire contents of which are incorporated by reference herein.

BACKGROUND

1. Technical Field

The present disclosure relates to an airfoil for an axial flow machine constituting a part of a gas turbine and the like.

2. Description of the Related Art

As is well known, the axial flow machine constituting a part of the gas turbine engine such as an aircraft engine includes rotor blades and stator vanes that perform compression of a fluid flowing in an axial direction. Some of these airfoils are enlarged along with recent development of the gas turbine engine. For example, as one of them, there is an outlet guide vane (OGV) that is a constitutional element of a fan sucking the outside air (refer to Japanese Patent Application Laid-Open Publication Nos. 2011-196179 and 2008-82337).

The outlet guide vane includes an airfoil body that rectifies discharged gas from the fan. The airfoil body has a pressure surface on one side of an airfoil thickness direction and a suction surface on the other side of the airfoil thickness direction. In addition, a platform is provided at an end portion of the airfoil body, which is located radially inside. The platform is formed into a plate shape as a wall that forms a channel of a fluid (for example, air).

SUMMARY

Incidentally, there is a tendency that the diameter of the fan is increased by the request of achieving a high bypass ratio aiming at improvement of fuel consumption of the aircraft engine. Not only a radial length of the outlet guide vane but also an axial length of the outlet guide vane is increased in association therewith. In this case, since the rigidity of the platform is lowered, a natural frequency of the platform is likely to be decreased. As a result, the strength of the platform against vibration is lowered. As countermeasures thereto, it is considered that the rigidity of the platform is increased by continuous formation of a rib for reinforcing the platform on a back surface of the platform, ranging from the upstream side to the downstream side. However, when such a rib is formed, the weight of the outlet guide vane is increased and weight reduction of the fan, in other words, weight reduction of the aircraft engine becomes difficult. The same problem is also generated in a case where a shroud has been provided on an end portion of the outlet guide vane located radaially outside.

Namely, there is a problem that promotion of weight reduction of the gas turbine engine such as the aircraft engine and maintenance or improvement of vibration resistance of the end wall that is the platform and the shroud are prone to have a trade-off relation, and thus attainment of both of them is difficult.

Accordingly, the present disclosure aims at providing an axial flow machine blade that can solve the aforementioned problems.

One aspect of the present disclosure is an airfoil for an axial flow machine, including: an airfoil body extending in a radial direction; an end wall provided at an end portion of the airfoil body in the radial direction, the end wall being formed into a plate shape as a wall of a channel in which the airfoil body is installed and which supports the airfoil body; and at least one convex portion formed so as to protrude from a back surface of the end wall in a direction away from the airfoil body, wherein the convex portion is formed integrally with a portion for generating a node of a primary vibration mode when an edge portion of the end wall vibrates as a free end of the primary vibration mode and raises a natural frequency of the primary vibration mode.

The convex portion may be separated from the edge portion of the end wall.

The convex portion may extend toward a portion corresponding to an antinode of the primary vibration mode at the edge portion of the end wall.

The convex portion may be provided individually for each of a plurality of primary vibration modes generated on the end wall.

The portion for generating the node of the primary vibration mode may be a portion connected to the end portion of the airfoil body on the end wall.

The airfoil may further include flanges that are provided on an upstream side and a downstream side of the end wall.

The end wall may be formed as a platform of the airfoil body. In this case, the blade may further include a dovetail provided on the back surface of the end wall, the dovetail including a shape fitted to a support member, and functioning as a portion for generating the node of the primary vibration mode.

The end wall and the convex portion may be formed of the same material.

According to the present disclosure, the axial flow machine blade that has attained promotion of weight reduction of the gas turbine engine such as the aircraft engine and maintenance or improvement of vibration resistance of the end wall can be provided.

DESCRIPTION OF THE EMBODIMENTS

The present disclosure is based on the following findings obtained by the inventors of the present application.

Figure 1:
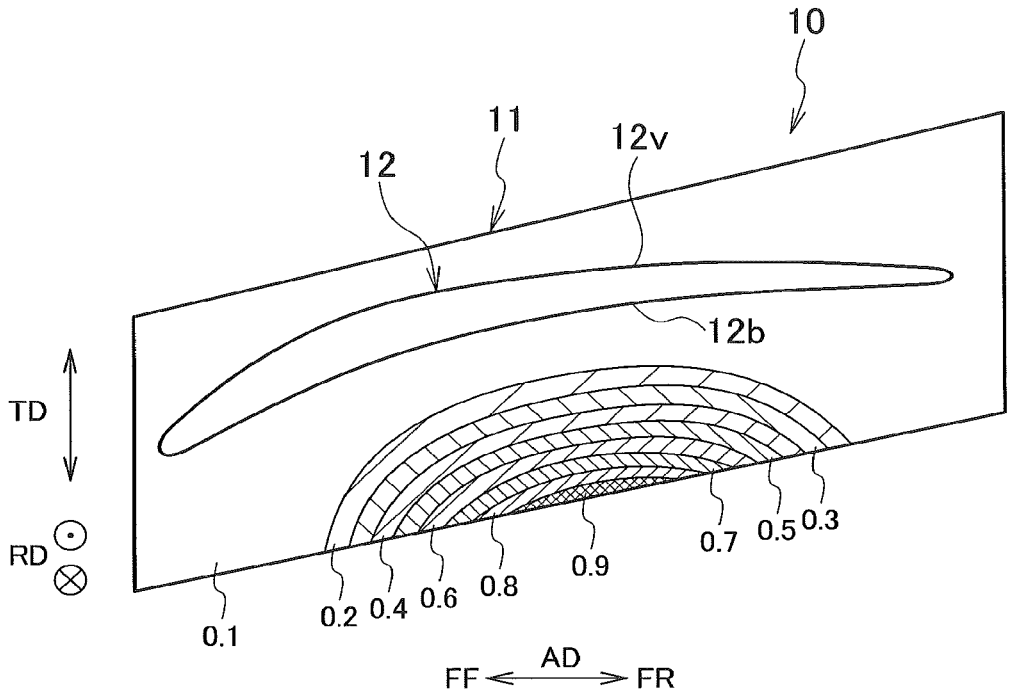
FIG. 1 is a diagram showing one example of an analysis result of a primary vibration mode generated on an end wall of an airfoil as an analysis object.

FIG. 1 is a diagram showing one example of an analysis result of a primary vibration mode generated on an end wall 11 of an airfoil 10 as an analysis object. In FIG. 1, [FF] indicates the upstream side (a forward direction) of a channel that an airfoil body 12 is installed, [FR] indicates the downstream side (a rear direction) of the channel concerned, [AD] indicates an axial direction, [RD] indicates a radial direction, [TD] indicates an airfoil thickness direction, respectively. The end wall 11 is a plate-shaped member that extends from the upstream side to the downstream side, constitutes a wall (a wall surface) of the channel as a platform that is provided on an end portion of the airfoil 10 located radially inside or as a shroud that is provided on an end portion of the airfoil 10 located radially outside. The end wall 11 supports the airfoil body 12 of the airfoil 10. The end wall 11 includes: a front surface (a first surface) 11*a* that faces the channel side; and a back surface (a second surface) 11*b* located on the opposite side of the front surface 11*a* (that is, it faces the outside of the channel).

The airfoil body 12 is installed such that its front end (a leading edge) is located on the upstream side and its rear end (a trailing edge) is located on the downstream side. The airfoil body 12 has a curved cross-section toward one side of the airfoil thickness direction and extends in the radial direction. In addition, the airfoil body 12 has a pressure surface 12*v* on one side of the airfoil thickness direction, and a suction surface 12*b* on the other side of the airfoil thickness direction. Note that the axial direction indicates an extending direction of an axis serving as a rotation center of a rotor blade and a standard of arrangement of components, and the radial direction indicates a direction of extending about this axis.

FIG. 1 shows one example of a displacement distribution of the end wall 11 during operation of the aircraft engine. Here, the operation of the aircraft engine means a series of operations of the aircraft engine from taking-off to landing. Each numerical value in FIG. 1 is made non-dimensional with a maximum displacement amount of the end wall 11 being set as 1.0. The maximum value (that is, the displacement amount 1.0) in this distribution is present in an area of 0.9 in displacement amount. Namely, maximum displacement in this analysis result is generated in the vicinity of the center of the end wall 11 in the axial direction and in the vicinity of an edge portion in the airfoil thickness direction. That is, this result means that a portion where the airfoil body 12 is provided on the end wall 11 functions as a portion for generating a node of a primary vibration mode, and a part of an edge portion 11*c* of the end wall 11 in the airfoil thickness direction vibrates as an antinode (a free end) F of the primary vibration mode.

In the present disclosure, the natural frequency of the primary vibration mode is increased by increase in the rigidity of the portion for generating the node of the primary vibration mode on the basis of this finding. Specifically, a later-described convex portion 15 is formed integrally with this portion. Here, "the portion (hereinafter, also called a "node generation portion" for the convenience of description) where the node of the primary vibration mode is generated" is a portion 14 that is connected to an end portion 13 of the airfoil body 12 on the end wall 11 as shown in, for example, FIG. 2. The portion 14 as one example of the node generation portion may be formed integrally with the end portion 13 of the airfoil body 12, or may have a structure (for example, a hole) having a cross-section capable of inserting (fitting) the end portion 13 and capable of supporting the end portion 13. Note that the end portion 13 may include a fillet (an airfoil body-supporting portion) that curves such that an outer surface (a side surface) of the airfoil body 12 is smoothly connected with the front surface 11*a* of the end wall 11.

Figure 2:
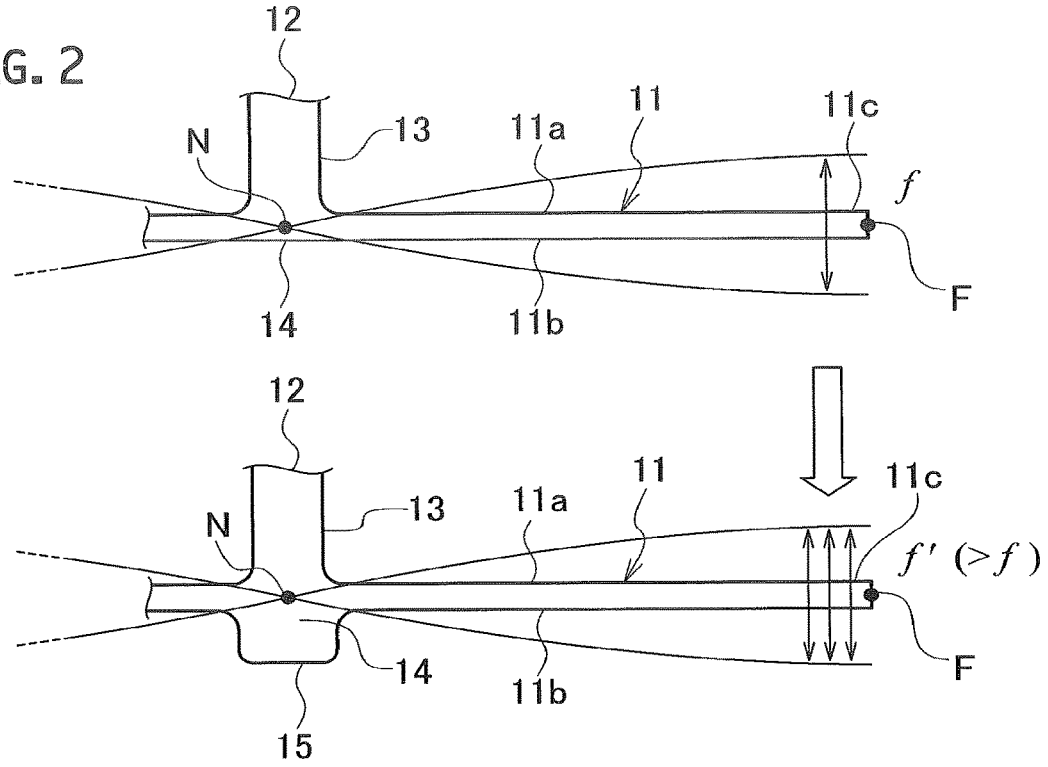
FIG. 2 is a diagram explaining an embodiment of the present disclosure.

As shown in FIG. 2, the convex portion 15 is provided integrally with the above-mentioned node generation portion at least by one. The convex portion 15 is formed so as to protrude from the back surface 11*b* of the end wall 11 in a direction away from the airfoil body 12. Namely, in a case where the end wall 11 is the platform, the convex portion is formed on a surface of the end wall 11 located radially inside, and in a case where the end wall 11 is the shroud, the convex portion is formed on a surface of the end wall 11 located radially outside.

The rigidity in a node N and in the periphery thereof is increased due to provision of the convex portion 15. Therefore, a natural frequency f' of the primary vibration mode in a case where the convex portion 15 is provided becomes higher than a natural frequency f of the primary vibration mode in a case where the convex portion 15 is not provided. Since the convex portion 15 is formed so as to protrude from the back surface 11*b* of the end wall 11 in the direction away from the airfoil body 12, the convex portion 15 does not interfere with the front surface 11*a* of the end wall 11 that faces a channel, while contributing to the increase in the rigidity. Furthermore, the convex portion 15 is locally provided on the back surface 11*b* of the end wall 11 and is separated from the edge portion 11*c* of the end wall 11. Namely, the convex portion 15 is not continuously provided from the upstream side toward the downstream side, like a conventional rib. That is, since the convex portion 15 is provided only on a portion where the convex portion 15 contributes to increase in the natural frequency, an unnecessary weight increase can be suppressed.

Figure 3:
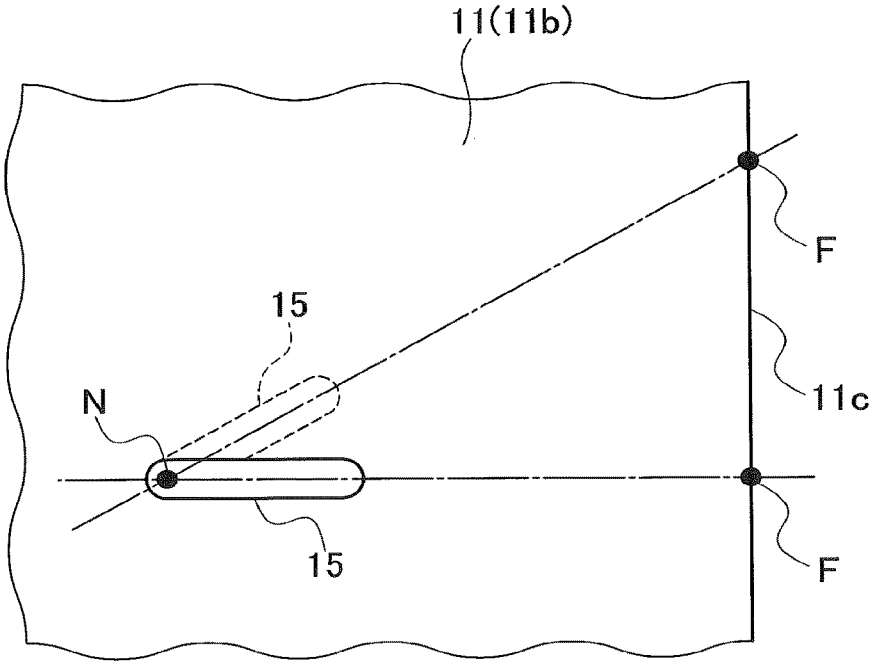
FIG. 3 is a diagram showing an outer surface (a back surface) of the end wall according to the embodiment of the present disclosure.

In order to obtain a desired increase in natural frequency, an increase of rigidity that is commensurate with the desired increase is required. In this case, as shown in FIG. 3, the convex portion 15 may be extended toward a portion corresponding to the antinode F of the primary vibration mode at the edge portion 11*c* of the end wall 11. Namely, the convex portion 15 may be extended up to a position located in the middle from the node generation portion (the portion 14) to the portion corresponding to the antinode F. The natural frequency of the primary vibration mode largely depends on the rigidity on a line that includes the antinode and the node of that mode. That is, an effective increase in rigidity cannot be obtained even when the rigidity of a portion deviating from this line is increased. Therefore, on the end wall 11, it is possible to increase the rigidity and to raise the natural frequency while suppressing the weight increase as much as possible, by extending the convex portion 15 from the portion corresponding to the node N of the primary vibration mode toward the portion corresponding to the antinode F.

A case where the plurality of primary vibration modes that would be concerned is generated at different places is also conceivable. In this case, the convex portion 15 may be provided individually for each of the plurality of primary vibration modes generated on the end wall 11. A part of the respective convex portions 15 may be mutually connected to each other or may be mutually separated from each other in accordance with positions where the antinode F and the node N are generated. In addition, as shown in FIG. 3, each convex portion 15 may also be formed so as to extend from the node N toward the antinode F of the target primary vibration mode, as necessary. In this case, it is possible to raise the natural frequency of each primary vibration mode.

Furthermore, it is also possible to suppress the weight increase as much as possible.

Note that the convex portion 15 may be formed by the same material as the end wall 11. In this case, integral formation of the convex portion 15 and the end wall 11 is facilitated.

Next, an embodiment of the present disclosure will be described with reference to FIG. 4 to FIG. 6. Note that, also in FIG. 4 to FIG. 6, [FF] indicates the forward direction (the upstream direction), [FR] indicates the rear direction (the downstream direction), [AD] indicates the axial direction, [RD] indicates the radial direction, [TD] indicates the airfoil thickness direction, respectively.

An axial flow machine according to the present embodiment is a fan in a gas turbine engine such as an aircraft engine, and the airfoil according to the present embodiment is the outlet guide vane of the fan. As shown in FIG. 4, the aircraft engine includes a tubular core cowl 3, and a tubular fan case 7 arranged outside the core cowl 3. An annular core channel 5 is formed inside the core cowl 3. In addition, an annular bypass channel 9 is formed between an inner circumferential surface of the fan case 7 and an outer circumferential surface of the core cowl 3. A fan 1 according to the present embodiment is adapted to take air as a fluid into the core channel 5 and the bypass channel 9.

A front part of the core cowl 3 is provided with a fan disk 16 so as to be rotatable via a bearing and the like. The fan disk 16 is coupled to a plurality of stages of low-pressure turbine rotors (illustration is omitted) of a low-pressure turbine (illustration is omitted) arranged behind the fan 1.

A rotor blade 17 is fitted into the fan disk 16. Each rotor blade 17 includes a blade body 19 as the airfoil body, a platform 21 provided on an end portion radially inside the blade body 19, and a dovetail 23 that is formed radially inside the platform 21 and can be fitted into the fan disk 16.

A plurality of outlet guide vanes 37 that rectifies the flow of air is provided at equal intervals on the downstream side of the rotor blade 17 between the core cowl 3 and the fan case 7, in a circumferential direction.

Figure 4:
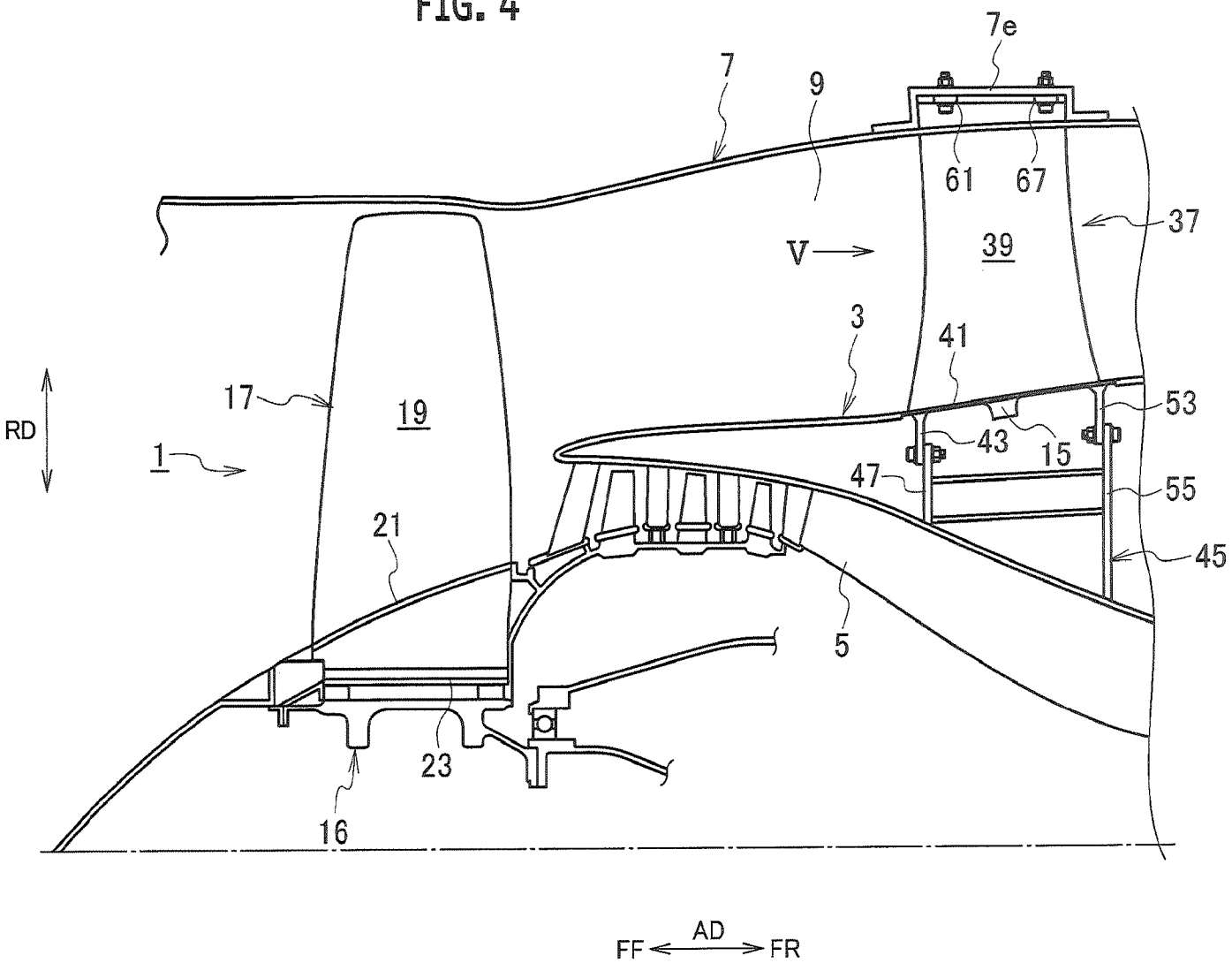
FIG. 4 is a half-side cross-sectional diagram of a front-side portion of the aircraft engine that includes a fan according to the embodiment of the present disclosure.
Figure 5:
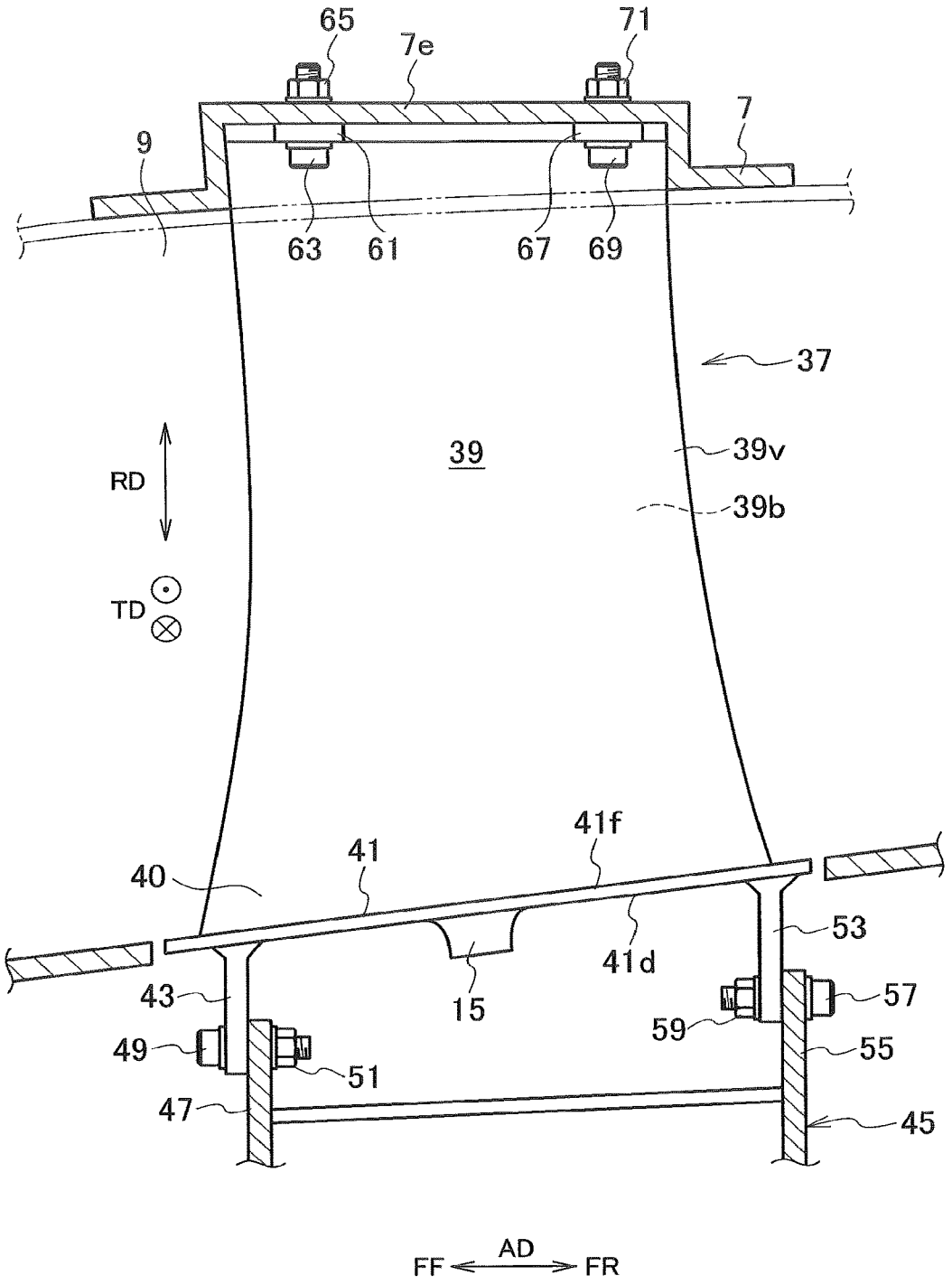
FIG. 5 is an enlarged diagram of an arrow view part V in FIG. 4.

As shown in FIG. 4 and FIG. 5, the outlet guide vane 37 includes a guide vane body 39 as the airfoil body. The guide vane body 39 has a pressure surface 39*v* located on one side of the airfoil thickness direction and a suction surface 39*b* located on the other side of the airfoil thickness direction. A platform 41 is provided at an end portion 40 of the guide vane body 39, which is located radially inside. The platform 41 has a front surface 41*f* as a channel surface of air, which is located radially outside.

The platform 41 has a back surface 41*d* on the opposite side of the front surface 41*f*. An arc-shaped flange 43 is formed on the upstream side (the front end side) on the back surface 41*d*. The flange 43 is fastened to an annular or arc-shaped mating flange 47 that has been formed on an outer circumferential surface of a tubular fan frame 45 that is a part of the core cowl 3, with a bolt 49 and a nut 51. An arc-shaped flange 53 is formed on the downstream side (the rear end side) on a back surface 41*d* of the platform 41. The flange 53 is fastened to an annular or arc-shaped mating flange 55 that has been formed on the downstream side of the mating flange 47 on the outer circumferential surface of the fan frame 45, with a bolt 57 and a nut 59.

A connection piece 61 is formed on the leading edge side (the upstream side) of a tip end (an end portion located radially outside) of the guide vane body 39. The connection piece 61 is fastened to a large-diameter part 7*e* of the fan case 7, with a bolt 63 and a nut 65. A connection piece 67 is formed on the trailing edge side (the downstream side) of the tip end of the guide vane body 39. The connection piece 67 is fastened to the large-diameter part 7*e* of the fan case 7, with a bolt 69 and a nut 71.

Figure 6:
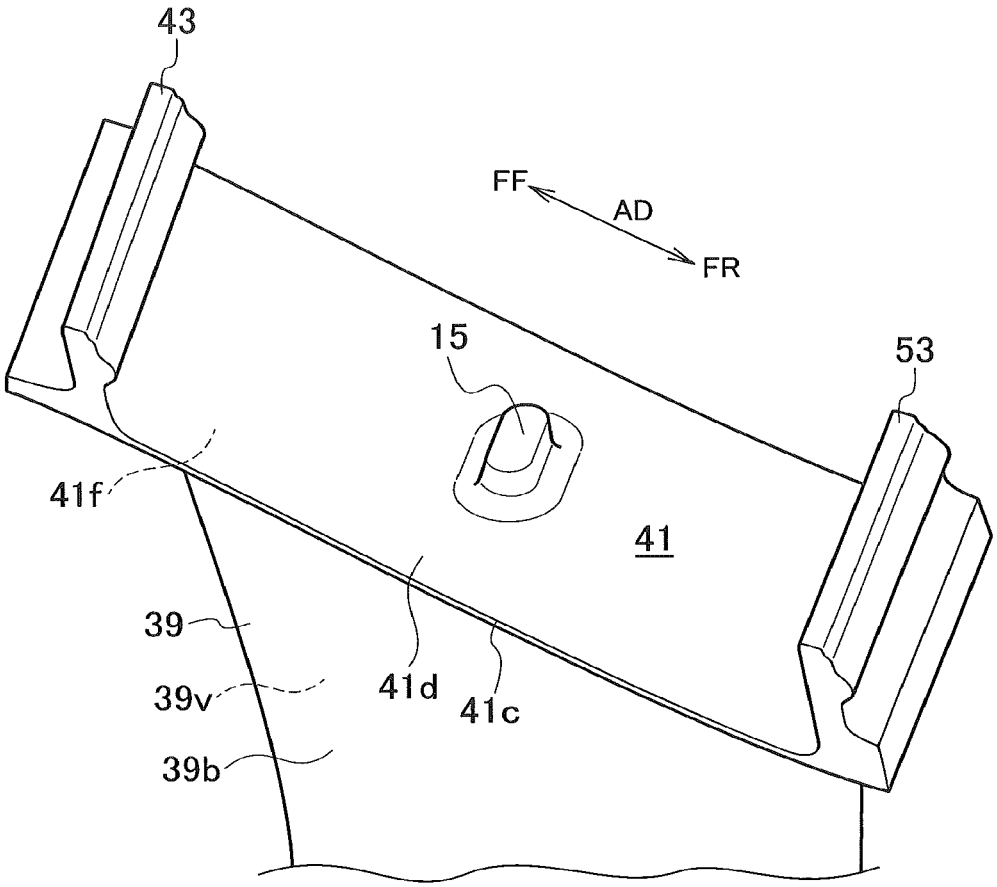
FIG. 6 is a partial perspective view of an outlet guide vane according to the embodiment of the present disclosure, viewed radially inward.

As shown in FIG. 5 and FIG. 6, the above-mentioned convex portion 15 is formed on the back surface 41*d* of the platform 41. In a case of the platform 41, the convex portion 15 is formed integrally with a portion for generating the node of the primary vibration mode when an edge portion 41*c* of the platform 41 vibrates as a free end of the primary vibration mode. Namely, in the case of the platform 41, the convex portion 15 is formed integrally with a portion to which the end portion 40 of the guide vane body 39 is connected. In addition, the convex portion 15 protrudes radially inward. A height of the convex portion 15 in the radial direction is arbitrary as long as the height does not interfere with other members and mechanical strength can be obtained.

Figure 7:
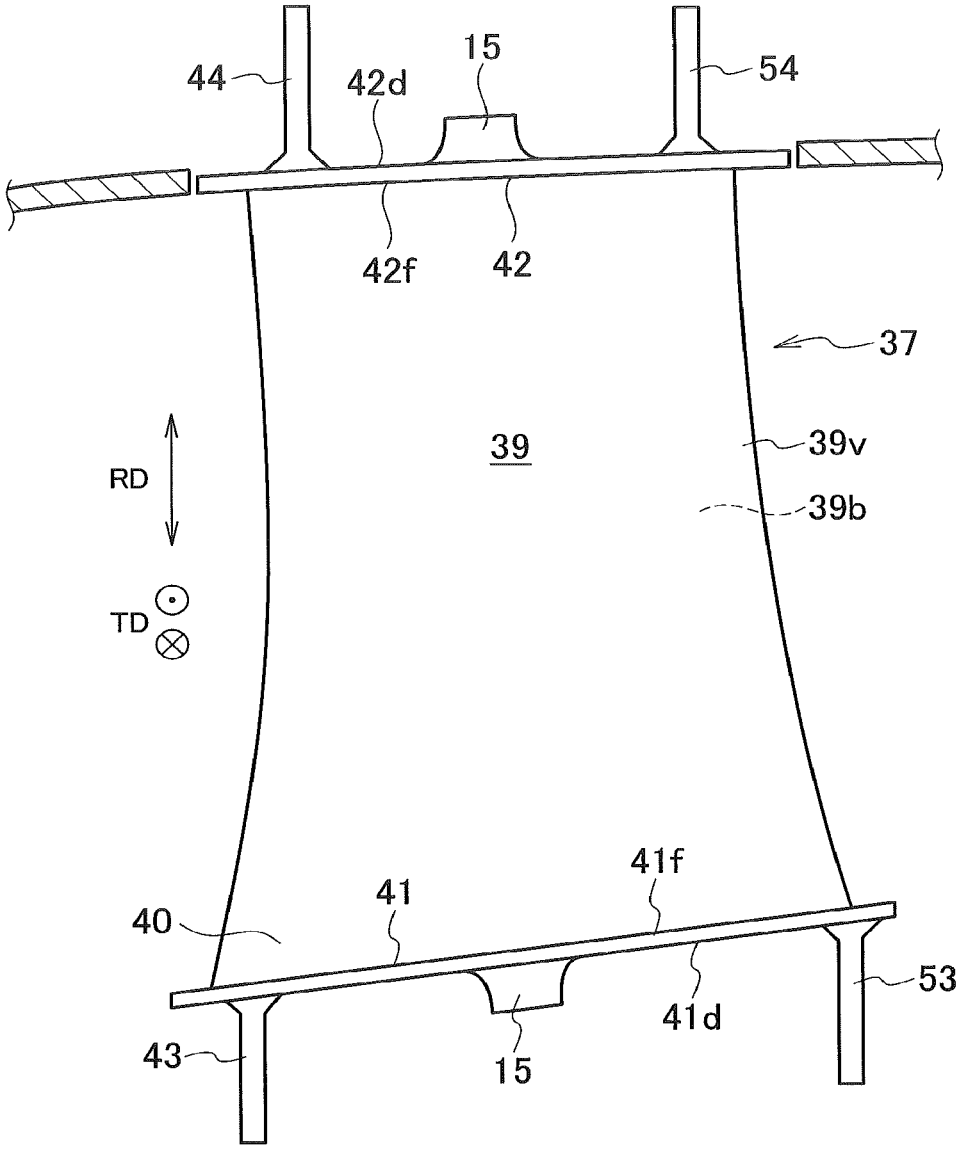
FIG. 7 is a diagram showing a modification of the outlet guide vane according to the embodiment of the present disclosure.

As shown in FIG. 7, the leading end of the guide vane body 39 may be provided with a shroud 42 in place of provision of the connection pieces 61, 67 and the like. The shroud 42 is formed into a plate shape similarly to the platform 41, and has a front surface 42*f* as the channel surface of air, which is located radially inside and has a back surface 42*d* on the opposite side of the front surface 42*f*. In a case where the shroud 42 is to be fixed to the fan case 7, for example, flanges 44, 54 are provided on the upstream side and the downstream side of the back surface 42*d* and are fixed to a fixing member having a similar shape to the fan frame 45 shown in FIG. 5.

In a case where the shroud 42 is provided, it is also possible to form the convex portion 15 according to the present embodiment on the back surface 42*d* thereof. In this case, the convex portion 15 on the back surface 42*d* of the shroud 42 is formed on the basis of the similar guideline to that of the convex portion 15 that has been provided on the back surface 41*d* of the platform 41. Namely, the convex portion 15 on the back surface 42*d* of the shroud 42 is formed integrally with a portion for generating the node of the primary vibration mode when the edge portion (not shown) of the shroud 42 vibrates as the free end of the primary vibration mode, on the shroud 42.

Figure 8:
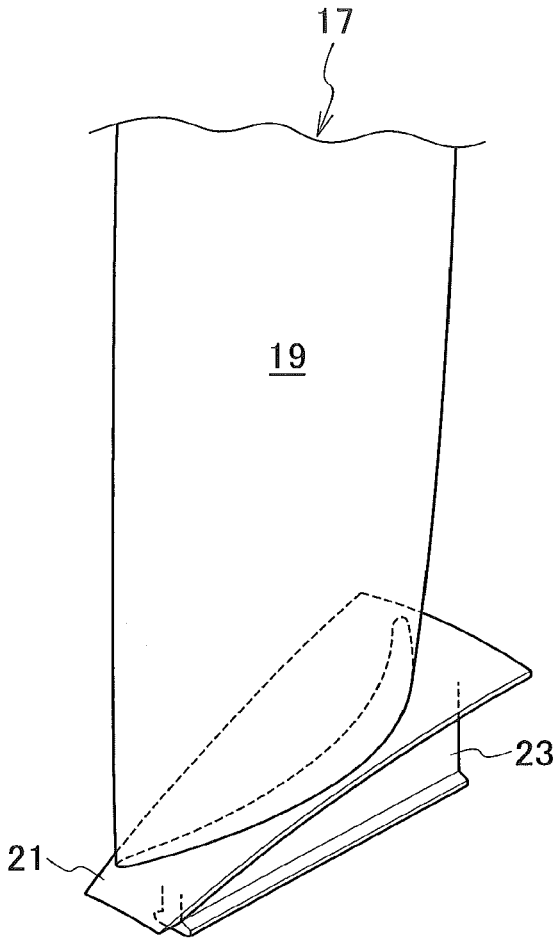
FIG. 8 is a perspective view of a rotor blade in the fan shown in FIG. 4.
Figure 9:
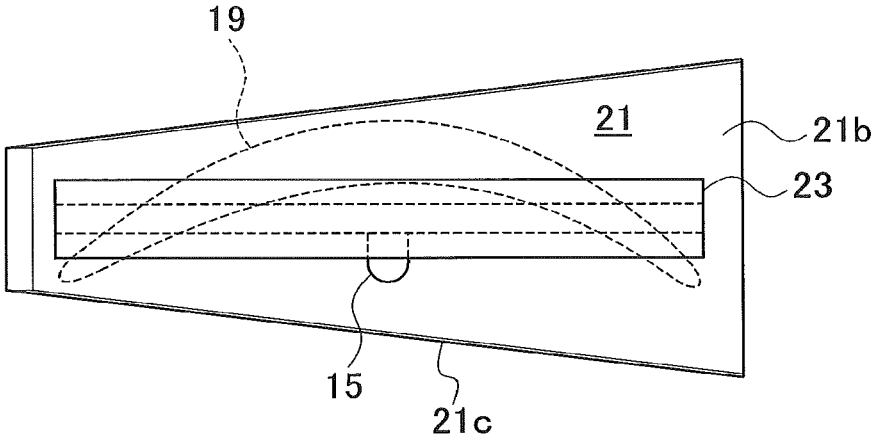
FIG. 9 is a back surface view of the rotor blade shown in FIG. 8, viewed radially inward.

The convex portion 15 according to the present embodiment is also applicable to the rotor blade 17 of the fan 1. FIG. 8 is a perspective view of the rotor blade 17 of the fan 1, and FIG. 9 is a diagram in which the platform 21 of the fan 1 has been viewed radially inward. In the rotor blade 17 of the fan 1, the dovetail 23 functions as a portion for generating the node of the primary vibration mode when a node generation portion of the platform 21, that is, an edge portion 21*c* of the platform 21 vibrates as the free end of the primary vibration mode. Therefore, the convex portion 15 is provided so as to protrude radially inward from a back surface 21*b* of the platform 21 which is the surface on which the dovetail 23 is provided, and is formed integrally with the dovetail 23. Note that, also in a case of the rotor blade 17, a portion of the platform 21 which is connected to the blade body 19 of the rotor blade 17 may sometimes correspond to the node generation portion of the platform 21. In this case, the convex portion 15 is formed integrally with the portion of the platform 21 which is connected to the blade body 19 of the rotor blade 17.

According to the above configuration, it is possible to provide the rotor blade or the outlet guide vane of the fan which has maintained or enhanced the vibration resistance by increasing the rigidity while suppressing weight increase as much as possible also in the case of size enlargement.

Note that the present disclosure is not limited to the above-mentioned embodiments and can be carried out in a variety of aspects by performing appropriate modification. Namely, the blade according to the present disclosure is applicable to the stator vanes and the rotor blades of all axial flow machines (for example, compressors and turbines) having a structure including the airfoil body and the platform that supports this airfoil body. Therefore, the scope of rights included in the present disclosure is not limited to these embodiments.

What is claimed is:

1. An airfoil for an axial flow machine, comprising:

an airfoil body extending in a radial direction;

an end wall provided at an end portion of the airfoil body in the radial direction, the end wall being formed into a plate shape as a wall of a channel in which the airfoil body is installed and which supports the airfoil body;

flanges provided on an upstream side and a downstream side of the end wall; and at least one convex portion protruding from a back surface of the end wall in a direction away from the airfoil body, located between and separately from the flanges, wherein the convex portion is formed integrally with a portion of the end wall for generating a node of a primary vibration mode when an edge portion of the end wall vibrates as a free end of the primary vibration mode, the convex portion being configured to raise a natural frequency of the primary vibration mode.

2. The airfoil according to claim 1, wherein the convex portion is separated from the edge portion of the end wall.

3. The airfoil according to claim 1, wherein the convex portion extends toward a portion corresponding to an antinode of the primary vibration mode at the edge portion of the end wall.

4. The airfoil according to claim 2, wherein the convex portion extends toward a portion corresponding to an antinode of the primary vibration mode at the edge portion of the end wall.

5. The airfoil according to claim 1, wherein the convex portion is provided individually for each of a plurality of primary vibration modes generated on the end wall.

6. The airfoil according to claim 2, wherein the convex portion is provided individually for each of a plurality of primary vibration modes generated on the end wall.

7. The airfoil according to claim 3, wherein the convex portion is provided individually for each of a plurality of primary vibration modes generated on the end wall.

8. The airfoil according to claim 4, wherein the convex portion is provided individually for each of a plurality of primary vibration modes generated on the end wall.

9. The airfoil according to claim 1, wherein the portion of the end wall for generating the node of the primary vibration mode is a portion of the end wall connected to the end portion of the airfoil body.

10. The airfoil according to claim 2, wherein the portion of the end wall for generating the node of the primary vibration mode is a portion of the end wall connected to the end portion of the airfoil body.

11. The airfoil according to claim 3, wherein the portion of the end wall for generating the node of the primary vibration mode is a portion of the end wall connected to the end portion of the airfoil body.

12. The airfoil according to claim 4, wherein the portion of the end wall for generating the node of the primary vibration mode is a portion of the end wall connected to the end portion of the airfoil body.

13. The airfoil according to claim 5, wherein the portion of the end wall for generating the node of the primary vibration mode is a portion of the end wall connected to the end portion of the airfoil body.

14. The airfoil according to claim 6, wherein the portion of the end wall for generating the node of the primary vibration mode is a portion of the end wall connected to the end portion of the airfoil body.

15. The airfoil according to claim 7, wherein the portion of the end wall for generating the node of the primary vibration mode is a portion of the end wall connected to the end portion of the airfoil body.

16. The airfoil according to claim 8, wherein the portion of the end wall for generating the node of the primary vibration mode is a portion of the end wall connected to the end portion of the airfoil body.

17. The airfoil according to claim 1, wherein the end wall and the convex portion are formed of the same material.

18. An airfoil for an axial flow machine, comprising:

an airfoil body extending in a radial direction;

a platform provided at an end portion of the airfoil body in the radial direction, the platform being formed into a plate shape as a wall of a channel in which the airfoil body is installed and which supports the airfoil body;

a dovetail provided on the back surface of the platform, the dovetail including a shape fitted to a support member, and functioning as a portion for generating a node of the primary vibration mode when an edge portion of the platform vibrates as a free end of the primary vibration mode; and at least one convex portion protruding from a back surface of the platform in a direction away from the airfoil body, the convex portion being formed integrally with the dovetail and being separated from the edge portion of the platform and configured to raise a natural frequency of the primary vibration mode.

19. The airfoil according to claim 18, wherein the convex portion extends toward a portion corresponding to an antinode of the primary vibration mode at the edge portion of the platform.

20. The airfoil according to claim 18, wherein the convex portion is provided individually for each of a plurality of primary vibration modes generated on the platform.

21. The airfoil according to claim 18, wherein the portion for generating the node of the primary vibration mode is a portion connected to the end portion of the airfoil body on the platform.

22. The airfoil according to claim 18, wherein the platform and the convex portion are formed of the same material.

* * * * *